United States Patent [19]

Endou

[11] Patent Number: 4,896,515

[45] Date of Patent: Jan. 30, 1990

[54] HEAT PUMP, ENERGY RECOVERY METHOD AND METHOD OF CURTAILING POWER FOR DRIVING COMPRESSOR IN THE HEAT PUMP

[75] Inventor: Hajime Endou, Tama, Japan

[73] Assignee: Mitsui Engineering & Shipbuilding Co., Tokyo, Japan

[21] Appl. No.: 129,876

[22] Filed: Dec. 4, 1987

Related U.S. Application Data

[63] Continuation of Ser. No. 916,768, Oct. 8, 1986, abandoned.

[30] Foreign Application Priority Data

Mar. 25, 1986 [JP] Japan ..... 61-64750
May 31, 1986 [JP] Japan ..... 61-12482

[51] Int. Cl.[4] ..... F25B 1/00
[52] U.S. Cl. ..... 62/498; 62/115
[58] Field of Search ..... 62/467 R, 235.1, 238.4, 62/324.1, 115, 498, 401; 237/2 B; 417/902

[56] References Cited

U.S. PATENT DOCUMENTS 2,494,120 1/1950 Ferro, Jr. .
3,153,442 10/1964 Silvern .
3,367,125 2/1968 McGrath .
3,932,159 1/1976 Goldsberry .
4,086,072 4/1978 Shaw ..... 62/235.1
4,177,651 12/1979 McFarland ..... 62/467 R
4,490,993 1/1985 Larriua ..... 62/304

FOREIGN PATENT DOCUMENTS 1113372 10/1954 France .
1401114 7/1964 France .
1568871 1/1968 France .
8202587 8/1982 Switzerland .
660771 11/1951 United Kingdom .

OTHER PUBLICATIONS

"Heat Pumps in Industry", by F. Moser and H. Schnitzer, pp. 19–21, ELSEVIER, New York, 1985.

*Primary Examiner*—Henry A. Bennet
*Attorney, Agent, or Firm*—Armstrong, Nikaido, Marmelstein, Kubovcik & Murray

[57] ABSTRACT

Disclosed are a heat pump, a method of energy recovery in the heat pump and a method of curtailing the required power for driving a compressor in the heat pump, which commonly center essentially upon providing a vapor-liquid separator for separating a working fluid introduced from a condensor through an expansion valve into vapor and liquid, an expansion turbine to be driven by the vapor separated through the vapor-liquid separator, and a compressor adapted to be driven by the expansion turbine, into which turbine a cooling liquid is atomized and sprayed.

8 Claims, 10 Drawing Sheets

HEAT PUMP, ENERGY RECOVERY METHOD AND METHOD OF CURTAILING POWER FOR DRIVING COMPRESSOR IN THE HEAT PUMP

This application is a continuation of application Ser. No. 916,768 filed 10/8/86, now abandoned.

BACKGROUND

The present invention relates to a heat pump, a method of recovery of energy in the heat pump and a method of curtailing the power required for driving a compressor in the heat pump.

Compression-type heat pumps comprise an evaporator which absorbs heat energy from a lower temperature heat source, a compressor which adiabatically compresses the working fluid vapor evaporated by the evaporator, a condenser which provides heat energy to a higher temperature heat sink by condensation of heat medium vapor having a temperature and a pressure raised by the compressor, and an expansion valve which flashes and expands the heat medium condensate formed in the condenser, wherein an arrangement is made such that from the expansion valve, the working fluid is sent back to the evaporator.

Where the output required is relatively small (for example up to about 500 kw), use is made as the compressor of one of displacement compressors such as reciprocating displacement compressors, rotating displacement compressors (including screw type ones) and so forth. Displacement compressors are simple in structure and, in addition, can provide a constant pressure ratio even under partial loading conditions by changing the number of rotation, so that they are suitably useful in or for heat pumps or heat pump systems. However, the volume of fluid that they can deal with is relatively limited and also their volume efficiency tends to lower under partial loading conditions, whereby it has been difficult to realize a scale-up of heat pumps with use of a displacement compressor.

Then, where a relatively large output is required, use is made primarily of a centrifugal-type compressor since centrifugal-type compressors characteristically have a large capacity of fluid compression in spite of their being relatively limited in size.

Whereas conventionally heat pumps have been utilized mainly for air conditioning purposes, lately it has been increasingly attempted to make use of heat pumps also in various industrial fields by elevating the operation or working temperature and enhancing the operation efficiency of the heat pump. The present invention is in line with such tendency in the art and seeks for effectively elevating the operation or working temperature of the heat pump up to about 300° C., which conventionally has been about 100° C. at the highest, and providing a heat pump which can satisfactorily stand practical uses even if a large extent of rise is made of the temperature so as to largely broaden the field of application or use of heat pumps.

Generally, as the temperature difference to be set between a (lower temperature) heat source and a heat sink is greater, the power required for driving the compressor becomes greater and the coefficient of performance (the ratio of transferred heat to the power input for the driving of the compressor -hereinafter referred to as COP-) becomes lowered.

Thus, although there have been attempts made to utilize heat pumps in industrial fields, it is difficult to attain a sufficient effect of energy saving in addition to the difficulty that it is costly to install a heat pump, and in many instances no high effect has been provided of the economical advantage and the investment, with the result that today still limited are the fields in which heat pumps are put for an actual or a practical use.

Also, whereas in order to adapt the heat pump to a high temperature operation, use is made of water for the heat medium or working fluid, now that vapor is adiabatically compressed to make it a superheated vapor or steam, it is necessary to appropriately adjust the degree of superheating.

SUMMARY OF THE INVENTION

It is a first object of the present invention to realize an improvement in or relating to the operation efficiency of heat pumps.

It is a second object of the invention to enhance the capacity of heat pumps by increasing the volume of fluid that a displacement compressor in or of the heat pump can deal with, and thereby reduce the production cost of plants.

It is a third object of the invention to raise the operation or working temperature of heat pumps and provide a heat pump suitable for a broader range of practical use in for example industrial fields, in comparison to conventional heat pumps.

In order to accomplish the first object of the invention or to improve the COP that is the most important one of performance indices of the heat pump, the present invention reduces the power required for the driving of the compressor. As a first means for accomplishing this object, the present invention atomizes and injects cooling water from an injection valve into superheated vapor which is in a compression process, and evaporates the cooling water. In this manner, isothermal compression or a compression approximate to it can be effected due to the cooling effect by evaporation, and the power necessary for driving the compressor can be reduced.

Whereas this method can be applied most optimally to a compressor of the reciprocating type, it can be applied also to a compressor of the screw type and the vane type and further to turbo compressors. This method can directly atomize the cooling water in a quantity matching with the existing state of the vapor during the compression process, and can control the temperature of the vapor during the compression by evaporation of cooling water.

As a second means for reducing the power for driving the compressor, the invention converts the internal energy possessed by a condensate generated in the compressor to power for driving the compressor. That is to say, according to the invention, in order to recover surplus energy in the heat pump, there are provided a vapor-liquid separator for separating the heat medium condensate in the heat pump introduced from the condenser through the expansion valve into vapor and liquid and also an expansion turbine to be driven by the heat medium vapor separated by the separator, and it is devised to drive the compressor by the expansion turbine.

Now that the required power for the driving of the compressor is curtailed as above, the COP of the heat pump can be enhanced according to the invention.

According to the energy recovery method of the invention, further, the pressure of the vapor expanded by the expansion turbine is set to be below the evaporation pressure, whereby a satisfactorily great power can be recovered.

As a third means for the energy recovery in the heat pump, the invention makes use of the heat medium liquid separated by the vapor-liquid separator as atomized liquid to be sprayed into the superheated vapor in the process of being compressed in the compressor. According to this method, the amount of condensate in the condensor is increased, so that the amount of vapor to be flashed by the expansion valve, too, is increased, whereby the recovery of power for the driving of the turbine is improved to enhance the operation efficiency of the heat pump.

According to the present invention, further, the heat medium vapor compressed in the compressor is guided into a desuperheater to reduce the degree of superheat of the vapor, and in doing this, the liquid separated by the vapor-liquid separator is atomized and sprayed into the desuperheater. According to this, the quantity of vapor to be flashed can be increased for same reasons as above, so that the recovery of power by the turbine can be improved to enhance the COP.

According to a fourth means for the energy recovery pursuant to the present invention, it is operated to heat the vapor separated by the vapor-liquid separator by a superheater utilizing for its heat source the condensate generated in the condenser, and supply vapor before being introduced into the expansion turbine to the expansion turbine, in the form of superheated vapor. According to this, a satisfactorily great expansion ratio can be obtained of the vapor in the expansion turbine to effectively enhance the efficiency of the energy recovery.

Generally, when saturate vapor is expanded by the expansion turbine, the degree of dryness (or the quality) of saturated vapor at the turbine outlet tends to become excessively low, and then to take into consideration the operation efficiency and the structural designing, it is infeasible to obtain a satisfactorily high pressure ratio. Thus, according to the present invention, it is proposed to superheat the saturated vapor at the inlet of the expansion turbine, suppress the degree of wetness of the vapor at the outlet of the turbine and, in addition, make use of the condensate before being flashed by the expansion valve, for the heat source for the superheating. Therefore, the invention is characterized in that it operates as a self heat exchange. In this manner, it is feasible to set the turbine expansion ratio at a raised value while keeping the quality of the vapor at the turbine outlet above a lower limit value and improve the recovery of power by the expansion turbine, so that the efficiency (COP) of the heat pump can be enhanced.

In order to accomplish the second object of the invention, the heat pump in accord with the invention is made including, at a stage preceding to the displacement compressor, a turbo compressor driven by the power recovery turbine so that the heat medium vapor is increased in its density and only then supplied into the displacement compressor. With this heat pump, the heat medium vapor can be supplied to the displacement compressor after its density is increased by the turbo compressor. Therefore, it is advantageously possible to increase the volume of vapor that the displacement compressor can deal with or, in other words, it is possible to reduce the size of the displacement compressor accordingly and curtail the production cost of the compressor. In this connection, further, essentially the turbo compressor is relatively small in size, and the advantage due to the reduction in the production cost as above well exceeds a disadvantage due to the incorporation of a turbo compressor, if made as above.

In accordance with the present invention, further, there are provided a vapor-liquid separator for separating the heat medium condensate introduced from the condenser through the expansion valve into vapor and liquid and an expansion turbine driven by the heat medium vapor separated by the separator, and an arrangement is made such that the turbo compressor, disposed at a preceding stage to the displacement compressor as stated above, is driven by the expansion turbine.

By making the expansion turbine comprising a velocity type turbine as above, the number of rotations of the compressor and of the turbine can be made to, with ease, correspond to each other.

As will become more clearly understood from considering the below recited description of specific embodiments of the invention, the invention provides such a heat pump which can exhibit a satisfactorily high COP in practical applications of the pump with use of a great temperature difference, and the invention is extremely useful for industrial applications.

To attain the third object, the present invention proposes, in addition to the foregoing described propositions, to make use of water for the working medium, and although in the following description of the invention water is termed to mean the working fluid or medium and steam is termed to represent vapor, it will be appreciated that this is not in any sense to limit the scope of the invention, which is to be understood to cover the use broadly of any other suitable working medium or fluid.

THE PREFERRED EMBODIMENTS

A conventional heat pump system will be first described before the present invention is described in detail.

Figure 1:
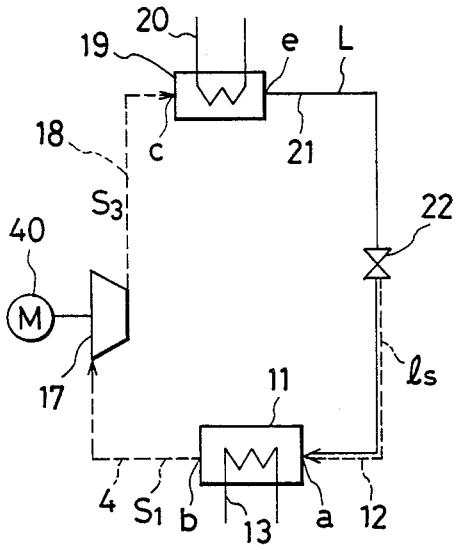
FIG. 1 PRIOR ART
FIG. 1 is a system diagram of a conventional heat pump.

As shown in FIG. 1, this compression heat pump comprises an evaporator 11 for absorbing heat energy from a low temperature heat source 13, a compressor 17 for adiabatically compressing a heat medium steam from the evaporator 11, a condenser 19 for providing the heat energy to a higher temperature heat sink 20 from the heat medium whose temperature and pressure are elevated by the compressor 17, and an expansion valve 22 for flushing and expanding the heat medium liquefied in the condenser 19. The heat medium is returned from the expansion valve 22 to the evaporator 11.

Thus, the conventional heat pump is not free from the problems described already.

Next, the heat pump in accordance with the present invention will be described.

Figure 2:
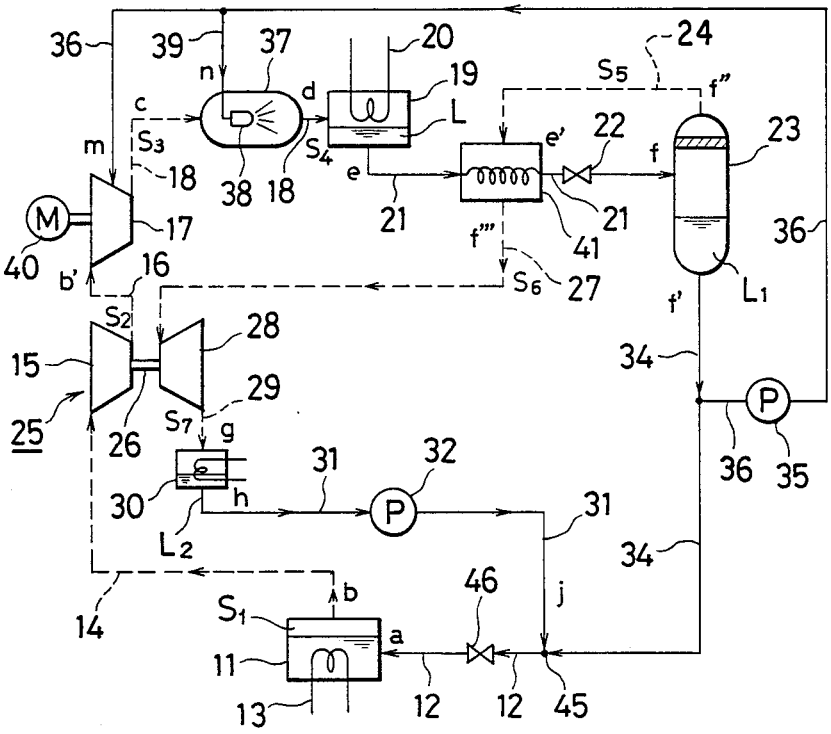
FIG. 2 is a system diagram of a heat pump in accordance with the present invention.
Figure 3:
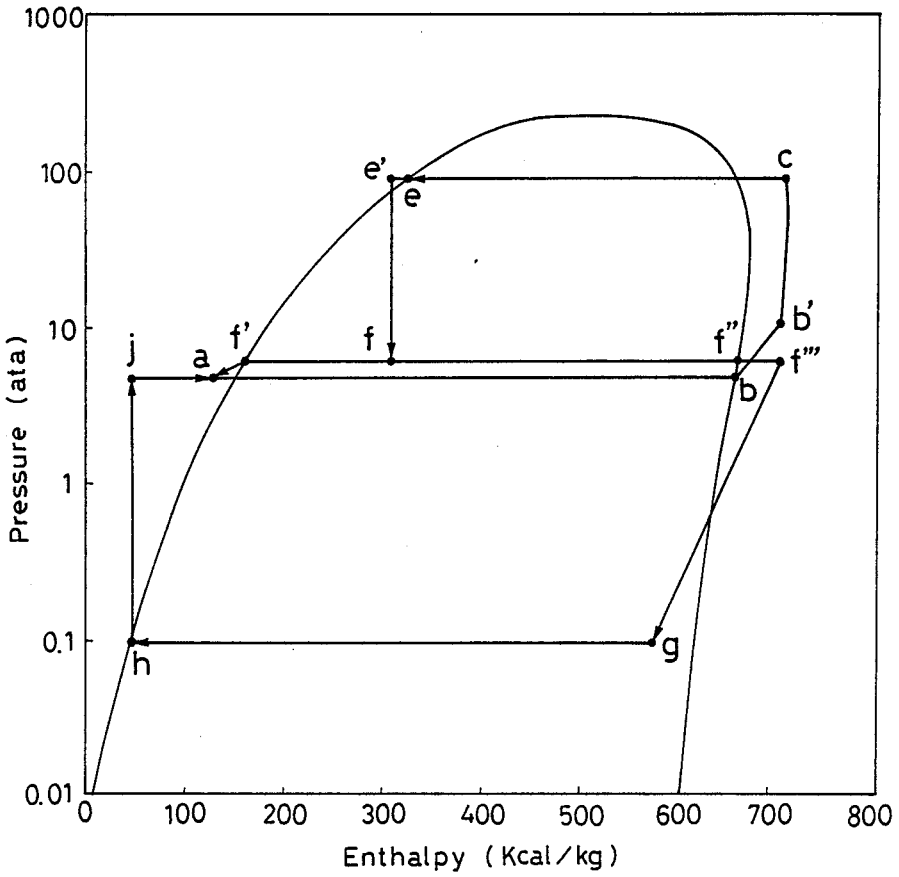
FIG. 3 is a Morrie diagram in the heat pump shown in FIG. 2.

FIG. 2 is a diagram of the heat pump in accordance with the present invention. The heat medium supplied from a piping arrangement 12 to an evaporator 11 absorbs heat from a low temperature heat source 13 and evaporates and turns into steam $S_1$, which is introduced into a foreside stage compressor 15 through another piping arrangement 14. The steam $S_1$ is compressed into an intermediate pressure steam $S_2$ by the compressor 15 and is introduced to another compressor 17 through a piping 16. The steam is compressed by the compressor 17 to a high temperature and high pressure steam $S_3$, which is supplied to a desuperheater 37 disposed at an intermediate portion of a piping 18. The desuperheater 37 has a nozzle 38, and the superheated steam $S_3$ makes direct heat exchange with a liquid heat medium atomized from this nozzle 38, and is cooled near to saturation and is changed to a substantially saturated steam $S_4$. This saturated steam $S_4$ is supplied to a condenser 19 through the piping 18. Since the heat medium atomized from the nozzle 38 evaporates and turns into a steam, too, the quantity of steam introduced into the condenser 19 increases.

The heat medium is atomized and sprayed into the compressor 17 through a pipe 36. The foreside stage compressor 15 is connected to a later-appearing expansion turbine 28 by a shaft 26, thereby forming a steam supercharger 25.

In the condenser 19, the heat energy of the saturated steam $S_4$ is supplied to the high temperature heat sink 20 and is condensed. The heat medium liquid L condensed in the condenser 19 makes indirect heat exchange with a later-appearing steam $S_5$ in a superheater 41 disposed at an intermediate portion of the piping 21 and is then expanded by the expansion valve 22. Thereafter, the heat medium liquid L is separated into a liquid $L_1$ and a steam $S_5$ by a vapor-liquid separator 23.

The steam $S_5$ is introduced into the superheater 41 through a piping 24, makes heat exchange with the heat medium liquid L derived from the condenser 19 and is heated to a superheated steam $S_6$. This superheated steam $S_6$ is introduced into the expansion turbine 28 for driving the foreside stage compressor 15 through a conduit 27. In the expansion turbine 28, the steam $S_6$ is expanded to a pressure below that of the evaporator and preferably, to vacuum, and a steam $S_7$ derived therefrom is sent to a condenser 30 through a piping arrangement 29, where it is condensed to a low temperature liquid $L_2$. After its pressure is raised by a pump 32 disposed at an intermediate portion of a piping 31, it is mixed by a mixer 45 with the liquid $L_1$ subjected to the vapor-liquid separation in the vapor-liquid separator 23 through a piping 31, and is thereafter recirculated to the evaporator 11 through the piping 12.

As the heat medium liquid atomized from m of the compressor 17 and n of the desuperheater 37, it is possible to use the heat medium liquid recirculated from the piping 12 to the evaporator 11 of this system or the heat medium liquid L derived from the condenser 19 or the heat medium liquid $L_1$ derived from the vapor-liquid separator 23, but it is recommended to use the heat medium liquid $L_1$ in the present invention. As shown in FIG. 2, the pressure of the heat liquid medium is raised by the pump 35 disposed at the intermediate portion of the piping 36 branched from the piping 34 and the heat medium liquid is then atomized and injected into the compressor 17 from a nozzle (not shown) at the tip of the pipe 36. Similarly, the heat medium liquid is atomized and injected from the nozzle 38 of the desuperheater 37 from the piping 39 branched from the piping 36. In the drawings, the reference numeral 40 represents a motor and 46 a pressure control valve.

Since the system shown in FIG. 2 contains all the necessary constituent elements of the present invention, the function of each constituent element will be described.

Figure 4:
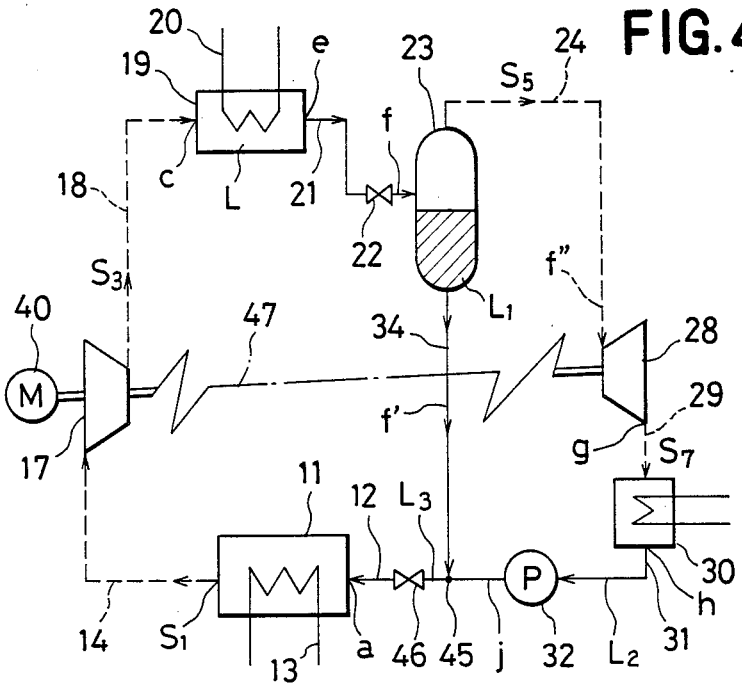
FIG. 4 is a system diagram, taken for illustration of the function of the heat pump according to the present invention.

Incidentally, like reference numerals are used in all the drawings to identify like constituent elements as in FIG. 2. FIG. 4 shows a fundamental system for converting the internal energy of the condensate in the condenser 19 to the power. The condensate is flashed by the expansion valve 22 and the resulting steam is supplied to the steam expansion turbine 28. The resulting power is used as part of the driving force for the compressor 17. Some conventional expansion turbines assembled in the heat pump are based upon the concept of expanding the steam to the evaporation pressure of the evaporator such as a total flow expander but they supply the resulting steam as such to the compressor. In accordance with the present invention, the resulting steam is expanded to a pressure below the evaporation pressure and preferably, to vacuum, and sufficiently great power is recovered. This is the characterizing feature of the present invention. Incidentally, it is necessary to condense the expanded steam by the condenser 30 and to raise its pressure to the evaporation pressure by the pump 32, but the power necessary therefor can be neglected. The compressor 17 and the expansion turbine 28 are directly connected by the shaft 47.

Figure 5:
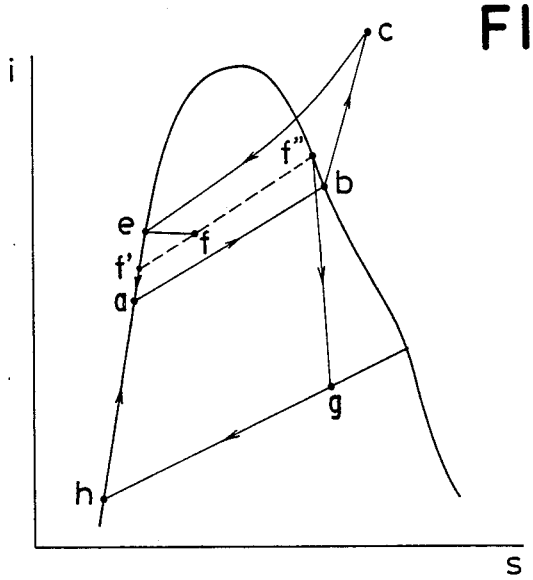
FIG. 5 is a Morrie diagram of the heat pump shown in FIG. 4.

FIG. 5 is a Morrie diagram which explains the operation of FIG. 4 and symbols a, b, c, e, f, f', f'', g and h correspond to the respective positions in FIG. 5.

Figure 6:
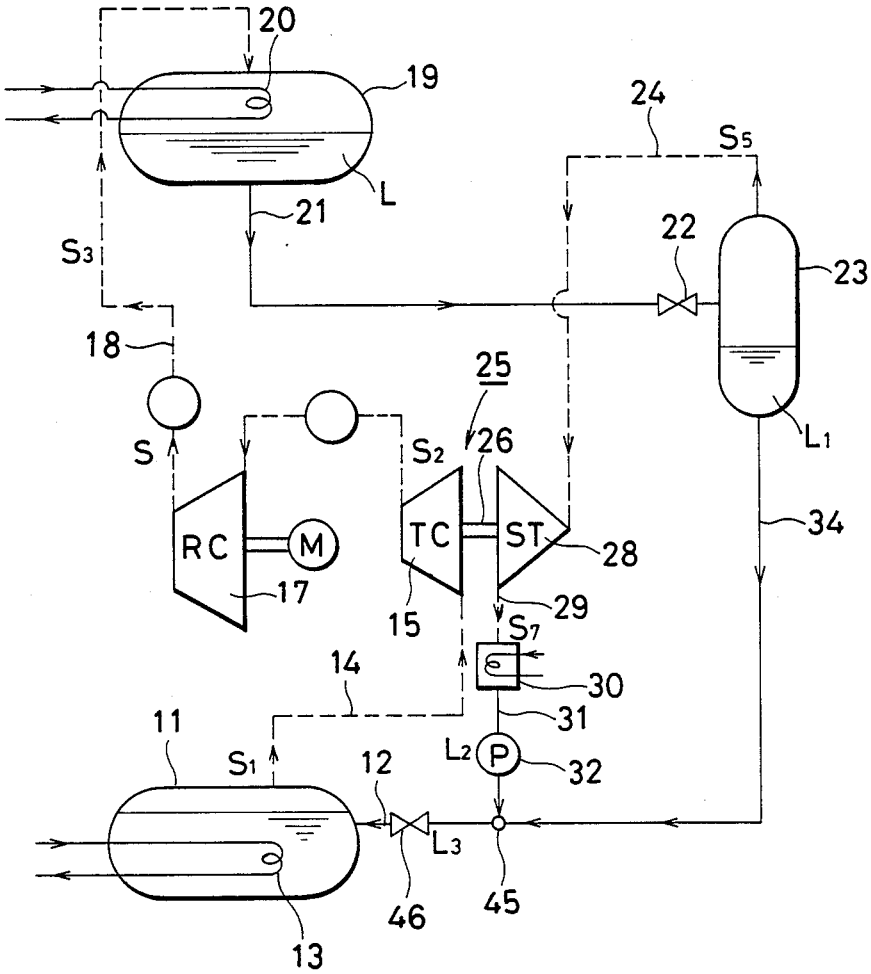
FIG. 6 and 7 are system diagrams, illustrative of the function of the heat pump according to the present invention.

FIG. 6 is a diagram of a system accomplishing the concept of FIG. 4 as an actual system, wherein the compressor 17 is a displacement compressor. The expansion turbine 28 is a steam turbine which is a turbo machine and the compressor 15 to be driven by the steam turbine is a turbo compressor which is also a turbo machine, and they are directly connected by the shaft 26, thereby forming a steam turbocharger 25.

Since the turbo machine rotates at a high speed, it is small in size and since it supercharges the displacement compressor, the latter can be made compact in size. Therefore, the cost of production can be reduced.

Figure 7:
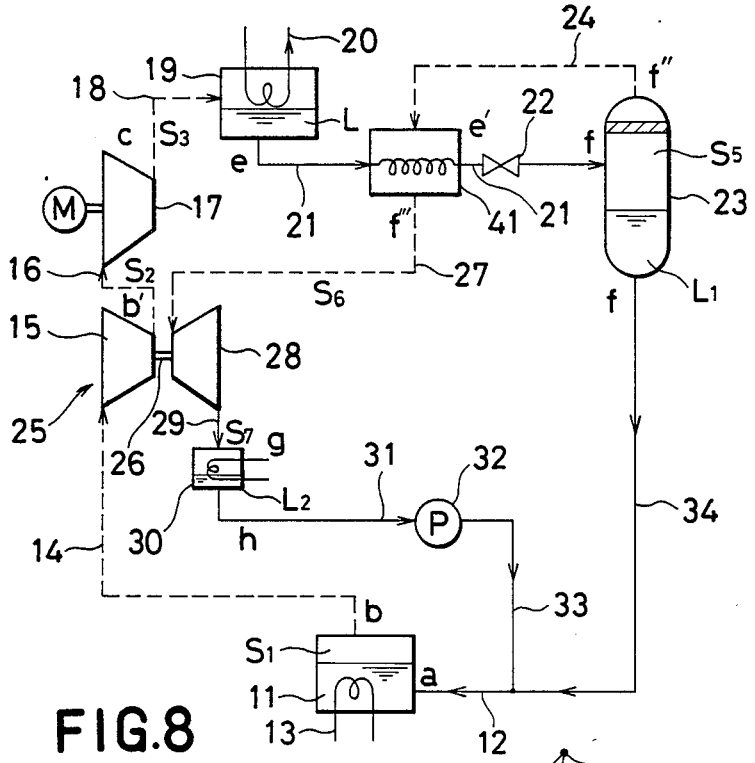

As shown in FIG. 7, in the superheater 41, the condensed hot water moves from e to e' and in this instance, emits the heat and heats the flashed steam. Therefore, the steam shifts from the saturated state f'' to the superheated state f'''. Since the steam is introduced into the turbine 28 in this superheated state, a greater expansion ratio can be secured without causing an excessive drop of the quality (dryness) of the steam at the turbine outlet.

Figure 9:
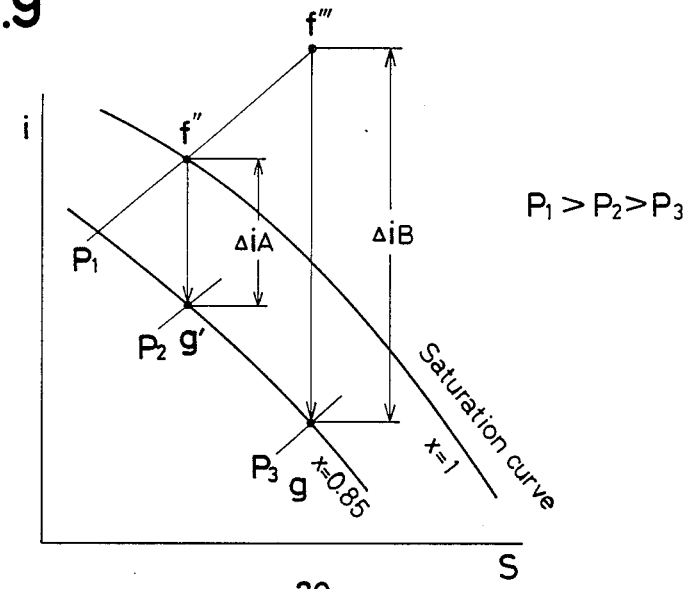
FIG. 9 is a Morrie diagram, representing the operation of a turbine unit.

Namely, in FIG. 9, it will be assumed that the saturated steam f'' having a pressure $P_1$ is adiabatically expanded in the turbine and the quality (dryness) x at the turbine outlet is 0.85. Then, the steam is expanded to g' and a pressure $P_2$ shown in FIG. 9. The thermal drop in this case is represented by $\Delta i_A$. If the steam is superheated at the same pressure $P_{iA}$ (f'''), the steam is expanded to a pressure $P_3$ when it is expanded to the same quality (dryness).

Figure 8:
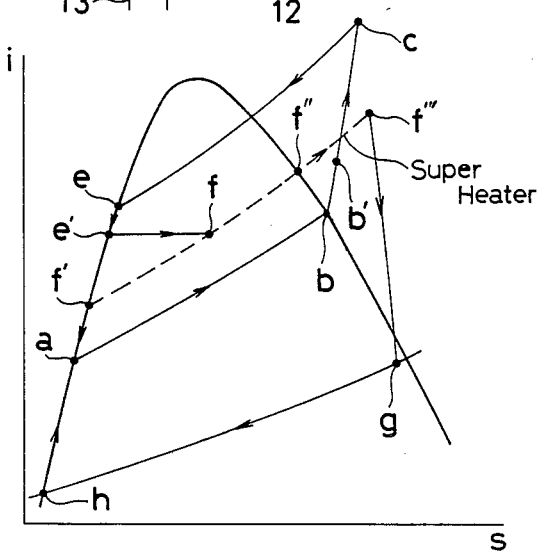
FIG. 8 is a Morrie diagram of the heat pump shown in FIG. 7.

FIG. 8 is a Morrie diagram of the heat pump system in accordance with the present invention. The positions represented by symbols a, b, b', c, e, e', f, f', f'', f''', g and h represent the same positions as those in FIG. 7.

Figure 10:
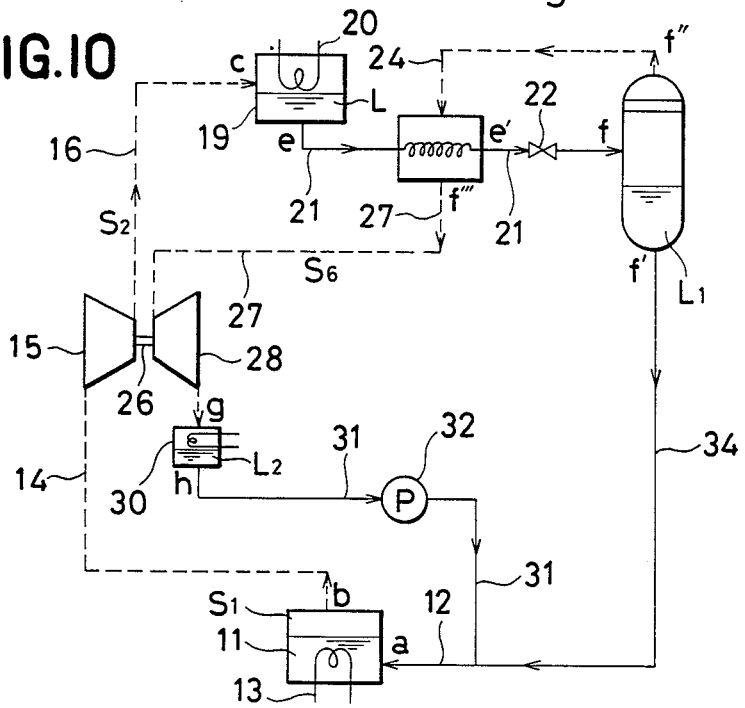
FIG. 10 is a system diagram of the heat pump according to the present invention.
Figure 11:
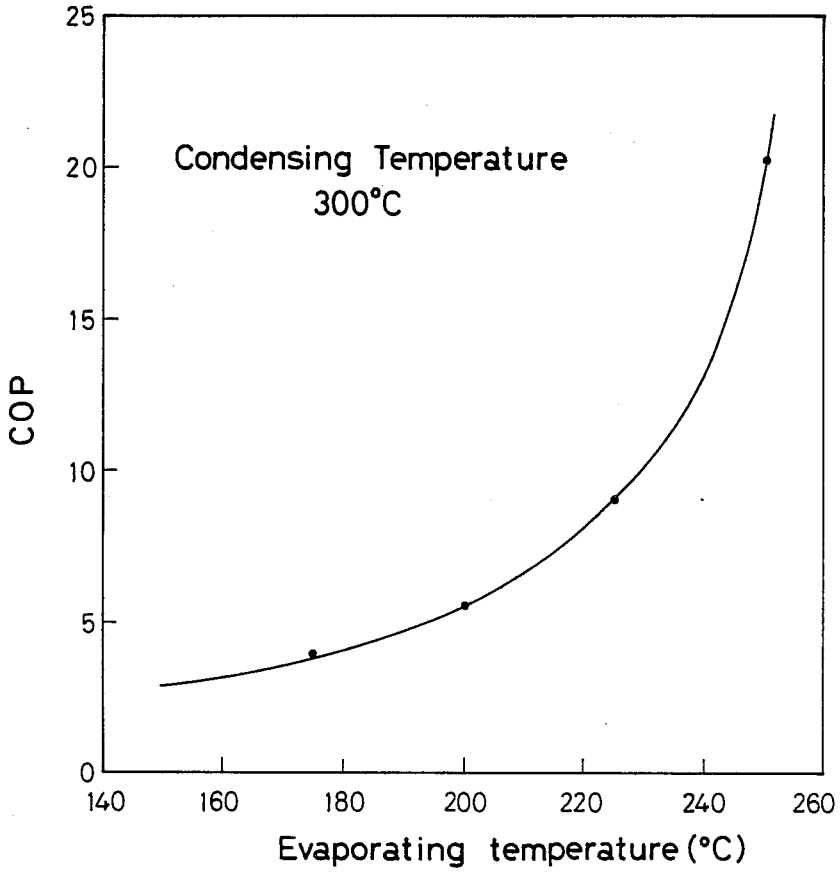
FIG. 11 is a diagram, showing the relation between the COP and the evaporation temperature.

FIG. 10 is a system flow diagram when the recovered power of the present invention exceeds the power necessary for compressing the steam. In such a case, some start means are necessary and the heat pump operates without external power. In case of the system performance at a condensation temperature of 300° C. as shown in FIG. 11, the system shown in FIG. 10 can be operated at an evaporation temperature of above 250° C. and since there is no external power in this case, the COP becomes indefinite.

On the other hand, in order to improve the performance of the heat pump, it is necessary according to the present invention to effect power recovery, and at the same time, to take into consideration a reduction of the compression power itself.

Figure 12:
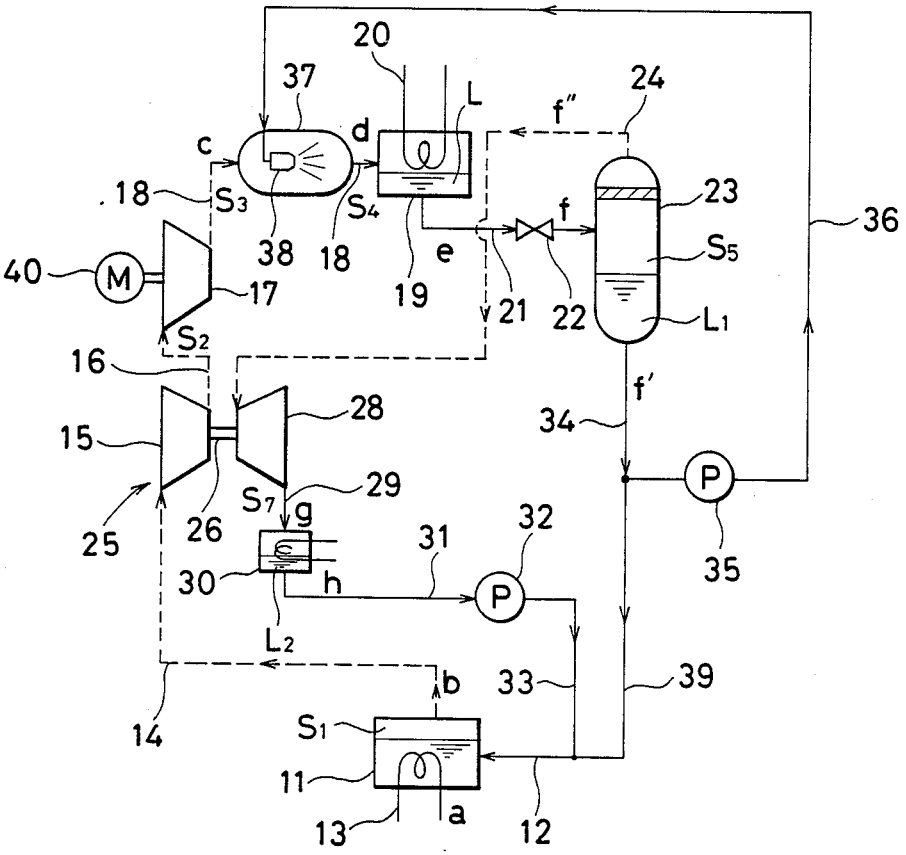
FIG. 12 is a system diagram of the heat pump of the present invention.

As shown in FIG. 12, the superheated steam $S_3$ having a high temperature and a high pressure which is compressed by the compressor 17 is supplied to the desuperheater 37 disposed at an intermediate portion of the piping 18. This desuperheater 37 has the nozzle 38, and the liquid heat medium atomized from this nozzle 38 cools the superheated steam $S_3$ into saturation. The saturated steam $S_4$ is supplied to the condenser 19 through the piping 18. The heat medium atomized from the nozzle 38 turns into the steam, too, and is therefore supplied to the condenser 19, where the quantity of steam thus increases.

Part of the liquid $L_1$ derived from the vapor-liquid separator 23 passes through the piping 36 branched from the piping 34 and its pressure is elevated by the pump 35. Then, the liquid is supplied to the nozzle 38 inside the desuperheater 37.

With the increase in the condensation quantity of the heat medium in the condenser 19, the flash steam quantity increase and contributes to the increase in the output of the expansion turbine 28. Since the output of the expansion turbine 28 is thus increased, the compression ratio of the foreside stage compressor 15 increases so that the power necessary for driving the motor 40 for driving the compressor 17 can be reduced.

Figure 13:
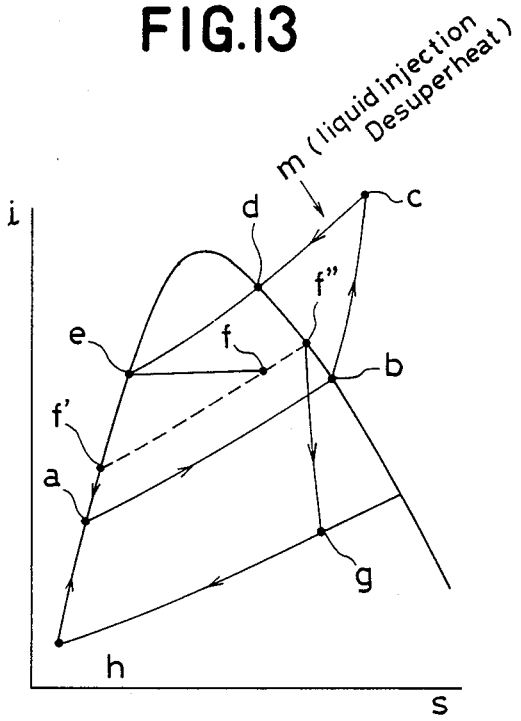
FIG. 13 is a Morrie diagram of the heat pump of FIG. 12.

FIG. 13 is a Morrie diagram of the heat pump system in accordance with the present invention, and symbols a, b, c, d, e, f, f', f'', g and h represent the same conditions at the positions represented by the same reference numerals in FIG. 12.

When water is used as the heat medium of the heat pump, the degree of superheating due to compression becomes extremely great. Accordingly, the heat transfer area of the condenser becomes large and the cost of production becomes great, too. In this sense, disposition of the desuperheater is advantageous from the viewpoint of the cost of production.

Figure 14:
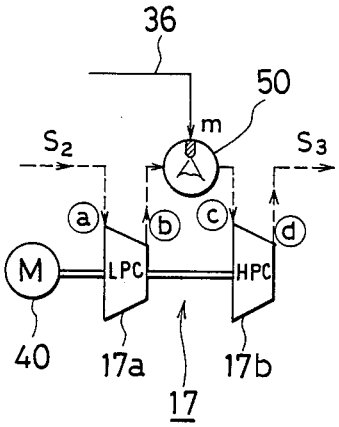
FIG. 14 is a schematic block diagram of a compressor having an intermediate cooler.

FIG. 14 shows a case where intermediate cooling is effected in order to reduce the compressor power. In this case, too, the flash liquid $L_1$ is injected into the cooler 50 disposed at the intermediate portion between the compressors **17*a* and 17*b* in order to reduce the temperature by direct heat exchange and evaporation. Since the flash steam quantity increases for the same reason as shown in FIG. 12**, the recovered power increases and the COP increases, too.

Figure 15:
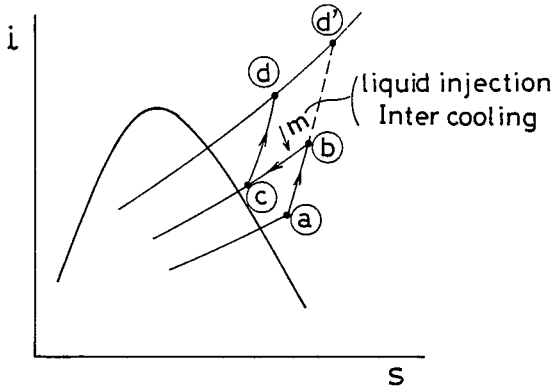
FIG. 15 is a Morrie diagram of the compressor shown in FIG. 14.

FIG. 15 is a Morrie diagram in the compression stroke when intermediate cooling is effected.

To further improve the effect of intermediate cooling shown in FIG. 14, the present invention uses a displacement compressor as the compressor 17, injects the liquid into the steam during its compression stroke, controls the compression temperature by the evaporation of the steam and brings the compression close to isothermal compression.

Next, the operation when the displacement compressor is used as the compressor and the heat medium liquid is atomized and injected from m will be explained.

Figure 16B:
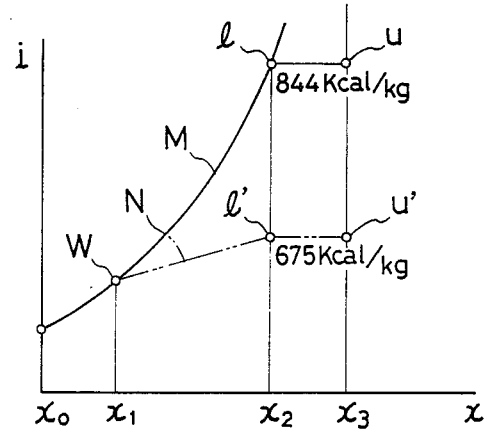
FIG. 16(B) is a diagram, showing the relation between enthalpy and the piston stroke.
Figure 16A:
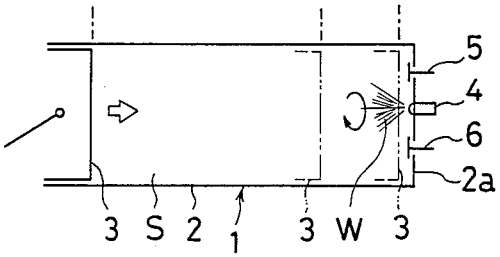
FIG. 16(A) is a schematic view of a compressor used for practising the gas compression method according to the present invention.

In FIG. 16(A), the liquid-atomizing type steam compressor 1 includes a piston 3 which reciprocates inside a cylinder 2 and a suction valve 5, a delivery valve 6 and a liquid atomizing valve 4 that are disposed at a cylinder head **2*a***.

The liquid atomizing valve 4 is specifically disposed in order to practise the present invention. Its operation timing is regulated so that when the piston 3 moves to the right and compresses the steam, the valve 4 atomizes the cooling liquid into the cylinder 2.

When the piston 3 is at the bottom dead point or the position represented by a solid line, the suction valve 5 and the delivery valve 6 that are fitted to the cylinder head **2*a* are closed, and the steam S is supplied into the cylinder 2** and is hermetically sealed therein.

When the piston 3 moves to the right as represented by a dash line, the capacity inside the sealed cylinder 2 decreases and the steam S is compressed so that the temperature and the pressure increase. During the steam compression process in which the piston 3 moves to the right, the high pressure heat medium liquid W is supplied in an atomized state from the liquid atomizing valve 4. The steam exchanges heat with the superheated steam sealed in the cylinder 2 and then evaporates. For this reason, it is possible to control the temperature rise of the steam S due to compression in accordance with the atomized quantity.

The opening and closing timing of the liquid atomizing valve 4 is regulated so that it stops atomization of the cooling liquid when the pressure inside the cylinder 2 reaches a predetermined value. Incidentally, liquid injection into a compressor has been known in the past, but the present invention is characterized in that the temperature control is effected while the steam in the superheated state makes direct heat exchange with the liquid and evaporates the liquid.

In FIG. 16(B), the curve M represents the increase of enthalpy of the steam with respect to the piston stroke x in the conventional steam compression method by adiabatic compression while the curve N represents that of the liquid atomizing system according to the present invention.

Figure 17:
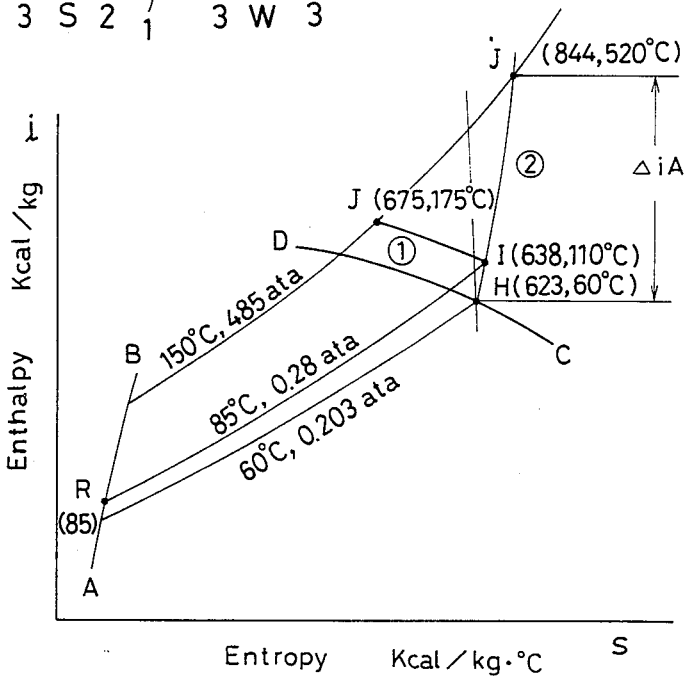
FIG. 17 is a diagram of steam in the vapor compression process in the compressor according to the present invention and in a conventional compressor, respectively.

In FIG. 17, the curve A–B represents a saturated liquid line while curve C–D represents a saturated steam line.

In this embodiment, a saturated steam H (60° C., 0.203 ata) is compressed to a steam I (110° C., 0.28 ata) and turned into a superheated steam. Here, when atomization of the cooling liquid W is started, the cooling liquid exchanges heat with the superheated steam from a point (85° C., 0.28 ata) on the curve A–B and evaporates, thereby cooling the steam S.

When the piston 3 is moved to continue the compression while controlling the quantity of the cooling liquid atomized from the liquid atomizing valve 4, the compression takes a route ① of the curve I–J and the steam becomes 175° C., 675 Kcal/kg at the final stage.

Here, the curve I–J and the curve C–D have the temperature difference of 25° C. for the same pressure.

In this diagram, too, the afore-mentioned effect can be obtained and the recovered power is increased by the injecting of the flash liquid L of the heat pump.

What is claimed:

1. A heat pump for delivering heat to a heat sink at elevated temperatures, comprising:
   - an evaporator including a heat source for changing liquid from a working fluid into a low pressure vapor by utilizing the heat from said heat source,
   - a compressor means for converting said low pressure vapor to high pressure vapor,
   - a condenser, including said heat sink, for receiving said high pressure vapor from said compressor means and supplying to said heat sink heat generated by condensing said high pressure vapor into a high pressure liquid,
   - an expansion valve for incompletely expanding said high pressure liquid and generating medium pressure vapor and liquid of the working fluid,
   - a vapor-liquid separator for separating said vapor and liquid received from said expansion valve, and
   - an expansion turbine connected to said vapor liquid separator to be driven by the vapor separated therein, said vapor being expanded in said turbine,
   - said expansion turbine partially powering said compressor means.

2. A heat pump as claimed in claim 1, wherein said compressor means is further powered by a motor.

3. A heat pump as claims in claim 2, wherein said compressor means comprises a displacement type compressor driven by said motor and a velocity type compressor driven by said turbine.

4. A heat pump for delivering heat to a heat sink at elevated temperature, comprising:
   - an evaporator including a heat source for changing a working fluid liquid to a low pressure vapor by utilizing heat from said heat source;
   - compressor means connected to said evaporator for converting said low pressure vapor to high pressure vapor;
   - a condenser, including said heat sink, for receiving said high pressure vapor from said compressor means and supplying to said heat sink heat generated by condensing said high pressure vapor;
   - an expansion valve and a vapor-liquid separator for receiving condensed working fluid from said condenser and producing therefrom medium pressure vapor working fluid;
   - wherein said compressor means comprises a velocity type compressor driven by said medium pressure vapor working fluid to increase density of said low pressure vapor which is then supplied to a displacement type compressor to produce said high pressure vapor provided to said condenser.

5. A heat pump for delivering heat to a heat sink at elevated temperature comprising:
   - an evaporator including a heat source for changing a working fluid liquid to a low pressure vapor by utilizing heat from said heat source;
   - compressor means connected to said evaporator for converting low pressure vapor to high pressure vapor;
   - a main condenser, including said heat sink, receiving said high pressure vapor from said compressor means and supplying heat to said heat sink generated by condensing said high pressure vapor;
   - an expansion valve and a vapor-liquid separator receiving condensed working fluid from said main condenser and producing therefrom medium pressure vapor and working fluid liquid, said working fluid liquid being supplied to said evaporator;
   - an expansion turbine connected to drive said compressor means, said turbine receiving said medium pressure vapor from said vapor-liquid separator and expanding said medium pressure vapor to a pressure below the pressure in the evaporator,
   - a second condenser receiving expanded vapor from said expansion turbine and condensing and liquefying said expanded vapor; and
   - a pump means connected to said second condenser for supplying the condensed and liquified expanded vapor to said evaporator.

6. The heat pump according to claim 5, further comprising a superheater means connected on a liquid side between said main condenser and said expansion valve and connected on a vapor side between said vapor-liquid separator and said expansion turbine for superheating said medium pressure vapor.

7. The heat pump according to claim 5, further comprising a desuperheater means connected between said compressor means and said main condenser receiving working fluid liquid from said vapor-liquid separator lower the degree of superheat of said high pressure vapor by spraying said working fluid liquid thereinto.

8. A heat pump as claimed in claim 1, wherein said compressor means incorporates an intermediate cooler, into which said liquid separated through said vapor-liquid separator is atomized and sprayed.

* * * * *

UNITED STATES PATENT AND TRADEMARK OFFICE

CERTIFICATE OF CORRECTION

PATENT NO. : 4,896,515

DATED : ENDOU

INVENTOR(S) : January 30, 1990

It is certified that error appears in the above-identified patent and that said Letters Patent is hereby corrected as shown below:

On the cover page, Item [30], line 2, "61-12482" should read --61-124682--.

Signed and Sealed this

Seventh Day of May, 1991

*Attest:*

HARRY F. MANBECK, JR.

*Attesting Officer*

*Commissioner of Patents and Trademarks*